US010495090B2

(12) United States Patent
Collins et al.

(10) Patent No.: US 10,495,090 B2
(45) **Date of Patent: *Dec. 3, 2019**

(54) ROTOR FOR A COMPRESSOR SYSTEM HAVING INTERNAL COOLANT MANIFOLD

(71) Applicant: INGERSOLL-RAND COMPANY, Davidson, NC (US)

(72) Inventors: James Christopher Collins, Mooresville, NC (US); Willie Dwayne Valentine, Statesville, NC (US); Stephen James Collins, Mooresville, NC (US)

(73) Assignee: Ingersoll-Rand Company, Davidson, NC (US)

( * ) Notice: Subject to any disclaimer, the term of this patent is extended or adjusted under 35 U.S.C. 154(b) by 628 days.

This patent is subject to a terminal disclaimer.

(21) Appl. No.: 14/837,912

(22) Filed: Aug. 27, 2015

(65) Prior Publication Data

US 2017/0058901 A1 Mar. 2, 2017

(51) Int. Cl.

| | |
|---|---|
| ***F04C 18/06*** | (2006.01) |
| ***F04C 29/04*** | (2006.01) |
| ***F04C 28/06*** | (2006.01) |
| ***F01C 21/08*** | (2006.01) |
| ***F04C 18/16*** | (2006.01) |
| ***F04C 18/107*** | (2006.01) |

(52) U.S. Cl.
CPC ..... *F04C 29/04* (2013.01); *F01C 21/08* (2013.01); *F04C 18/107* (2013.01); *F04C 18/16* (2013.01)

(58) Field of Classification Search
CPC ..... F04C 18/06; F04C 29/04; F04C 23/00; F04C 23/001; F04C 28/06
USPC ..... 418/63, 83, 94, 201.1, 205, 206.3
See application file for complete search history.

(56) References Cited

U.S. PATENT DOCUMENTS

| | | | |
|---|---|---|---|
| 2,325,617 | A | 8/1943 | Lysholm et al. |
| 2,714,314 | A | 8/1955 | Ulander |
| 2,799,253 | A | 7/1957 | Lindhagen et al. |
| 2,801,792 | A | 8/1957 | Lindhagen et al. |
| 2,918,209 | A | 12/1959 | Schueller |
| 3,405,604 | A | 10/1968 | Lysholm |
| 4,005,955 | A | 2/1977 | Pamlin |
| 5,772,418 | A | 6/1998 | Tateno et al. |
| 6,045,343 | A | 4/2000 | Liou |

(Continued)

FOREIGN PATENT DOCUMENTS

| | | |
|---|---|---|
| CN | 102242711 | 1/2014 |
| DE | 1021530 B | 12/1957 |

(Continued)

OTHER PUBLICATIONS

Jan. 30, 2017, European Search Report and Written Opinion, European Patent Application No. 16185305.6, 9 pages.

*Primary Examiner* — Mary Davis
*Assistant Examiner* — Dapinder Singh
(74) *Attorney, Agent, or Firm* — Taft Stettinius & Hollister LLP

(57) ABSTRACT

A rotor for a compressor system includes a rotor body having a coolant manifold with an inlet runner and a plurality of coolant supply conduits extending from the inlet runner toward an inner heat exchange surface. The coolant supply conduits may have a circumferential and axial distribution, and extend through struts enhancing stiffness in the rotor body.

21 Claims, 3 Drawing Sheets

(56) References Cited

U.S. PATENT DOCUMENTS

| | | | | |
|---|---|---|---|---|
| 6,758,660 | B2 | 7/2004 | Kriehn et al. | |
| 7,793,516 | B2 | 9/2010 | Farrow et al. | |
| 7,993,118 | B2 | 8/2011 | Prior et al. | |
| 8,192,186 | B2 | 6/2012 | Moens | |
| 9,683,569 | B2 * | 6/2017 | Collins | F04C 18/107 |
| 2010/0054980 | A1 * | 3/2010 | Moens | F04C 18/084<br>418/83 |
| 2010/0233006 | A1 * | 9/2010 | Yamamoto | F04C 18/16<br>418/206.3 |
| 2012/0045356 | A1 * | 2/2012 | Nachtergaele | F04C 18/16<br>418/55.1 |
| 2016/0123327 | A1 | 5/2016 | Collins et al. | |

FOREIGN PATENT DOCUMENTS

| | | | |
|---|---|---|---|
| EP | 1026399 | | 8/2000 |
| GB | 690185 | A | 4/1953 |
| WO | 2006024818 | A1 | 3/2006 |

* cited by examiner

ROTOR FOR A COMPRESSOR SYSTEM HAVING INTERNAL COOLANT MANIFOLD

TECHNICAL FIELD

The present disclosure relates generally to compressor rotors, and more particularly to compressor rotor cooling.

BACKGROUND

A wide variety of compressor systems are used for compressing gas. Piston compressors, axial compressors, centrifugal compressors and rotary screw compressors are all well-known and widely used. Compressing gas produces heat, and with increased gas temperature the compression process can suffer in efficiency. Removing heat during the compression process can improve efficiency. Moreover, compressor equipment can suffer from fatigue or performance degradation where temperatures are uncontrolled. For these reasons, compressors are commonly equipped with cooling mechanisms.

Compressor cooling generally is achieved by way of introducing a coolant fluid into the gas to be compressed and/or cooling the compressor equipment itself via internal coolant fluid passages, radiators and the like. Compressor equipment cooling strategies suffer from various disadvantages relative to certain applications.

SUMMARY

A rotor for a compressor system includes a rotor body having a coolant manifold with an inlet runner and a plurality of coolant supply conduits extending from the inlet runner toward an inner heat exchange surface so as to direct coolant fluid toward the same.

DETAILED DESCRIPTION OF THE FIGURES

Figure 1:
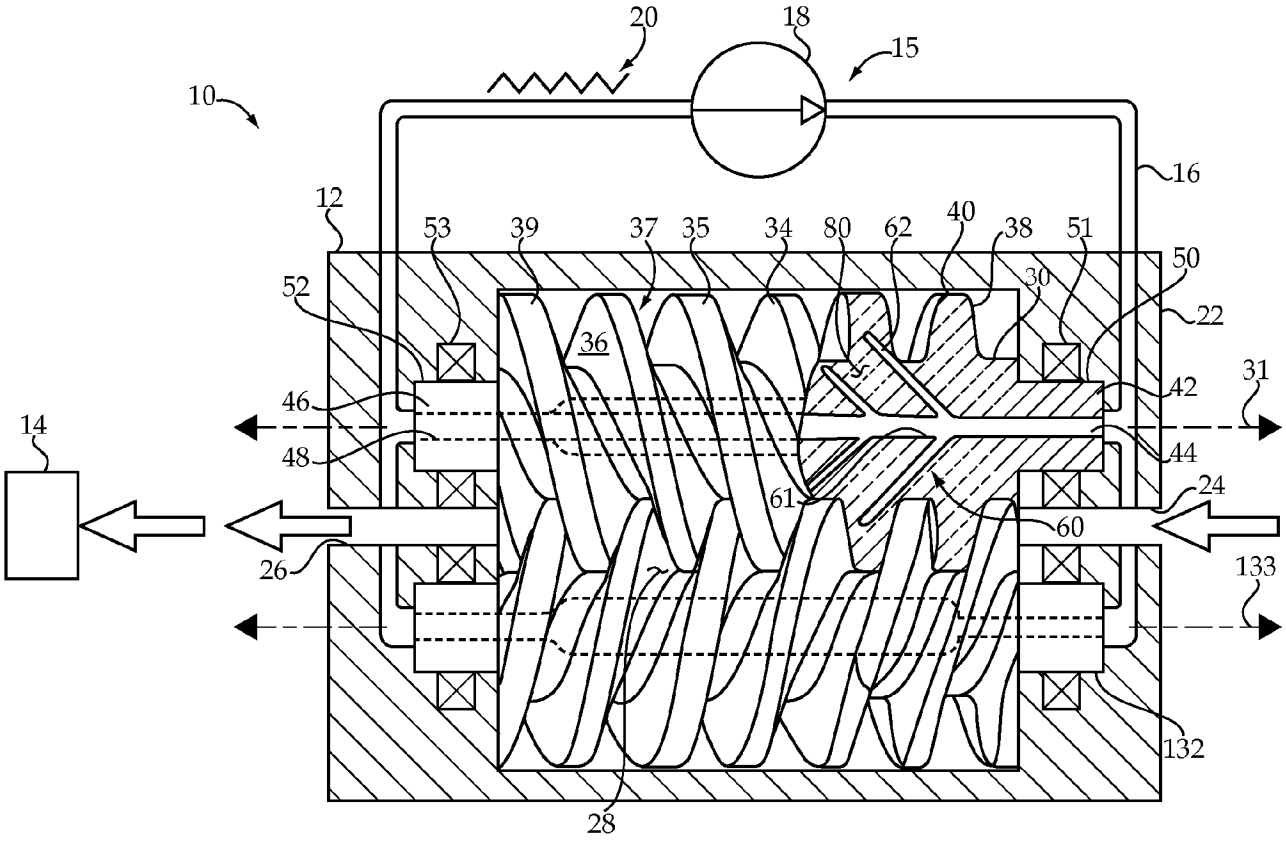
FIG. 1 is a partially sectioned diagrammatic view of a compressor system according to one embodiment.

For the purposes of promoting an understanding of the principles of the ROTOR FOR A COMPRESSOR SYSTEM HAVING INTERNAL COOLANT MANIFOLD, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring to FIG. 1, there is shown a compressor system 10 according to one embodiment and including a compressor 12, a compressed air powered device or storage vessel 14, and a cooling system 15 having a coolant loop 16, a coolant pump 18 and a heat exchanger such as a radiator or the like 20. Compressor 12 may be of the dual or twin rotary screw type, as further discussed herein, although the present disclosure is not thusly limited. Compressor 12 includes a compressor housing 22 having formed therein a gas inlet 24, a gas outlet 26, and a fluid conduit 28 extending between gas inlet 24 and gas outlet 26. A rotor 30 having a rotor body 39 is rotatable within housing 22 about an axis of rotation 31 to compress gas conveyed between gas inlet 24 and gas outlet 26. In the illustrated embodiment, compressor 12 includes rotor 30 and also a second rotor 132 rotatable about a second and parallel axis of rotation 133. While rotors 30 and 132 are shown having similar configurations, it should be appreciated that dual rotary screw compressors according to the present disclosure will typically include a male rotor and a female rotor, example features of which are further described herein. Except where otherwise indicated, the present description of one of rotors 30 and 132, and any of the other rotors contemplated herein, should be understood as generally applicable to the present disclosure. As will be further apparent from the following description, by virtue of unique cooling strategies and rotor construction the present disclosure is expected to be advantageous respecting system reliability and operation, as well as hardware robustness and efficiency in compressing gasses such as air, natural gas, or others.

Rotor 30 includes an outer compression surface 36 exposed to fluid conduit 28 and structured to impinge during rotation upon gas conveyed between gas inlet 24 and gas outlet 26. Rotor 30 also includes an inner heat exchange surface 38 defining a cooling cavity 80. In a practical implementation strategy, rotor 30 includes a screw rotor where outer compression surface 36 forms a plurality of helical lobes 35 in an alternating arrangement with a plurality of helical grooves 37. As noted above, rotor 30 may be one of a male rotor and a female rotor, and rotor 132 may be the other of a male rotor and a female rotor. To this end, lobes 35 might have a generally convex cross-sectional profile formed by convex sides, where rotor 30 is male. In contrast, where structured as female rotor 132 may have concave or undercut side surfaces forming the lobes. Lobes 35 and grooves 37 might be any configuration or number without departing from the present disclosure, so long as they have a generally axially advancing orientation sufficient to enable impingement of outer compression surface 36 on gas within fluid conduit 28 when rotor 30 rotates. Embodiments are also contemplated where system 10 includes one working rotor associated with a plurality of so-called gate rotors.

Rotor 30 may further include an outer body wall 40 extending between outer compression surface 36 and inner heat exchange surface 38. During operation, the compression of gas via rotation of rotor 30 generates heat, which is conducted into material from which rotor 30 is formed. Heat will thus be conducted through wall 40 from outer compression surface 36 to heat exchange surface 38. Rotor 30 further includes a first axial end 42 having a coolant inlet 44 formed therein, and a second axial end 46 having a coolant outlet 48 formed therein. A coolant manifold 60 fluidly connects with coolant inlet 44, and includes an inlet runner 61 and a plurality of coolant supply conduits 62 structured to supply a coolant to inner heat exchange surface 38. In a practical implementation strategy, conduits 62 extend outwardly from inlet runner 61 at a plurality of axial and circumferential locations, such that conduits 62 have an axial and circumferential distribution. As further described herein, conduits 62 are structured so as to direct coolant toward, and in some instances spray coolant at, inner heat exchange surface 38. Each of first and second axial ends 42 and 46 may include a cylindrical shaft end having a cylindrical outer surface 50 and 52, respectively. Journal and/or thrust bearings 51 and 53 are positioned upon axial ends 42 and 46, respectively, to react axial and non-axial loads and to support rotor 30 for rotation within housing 22 in a conventional manner.

As mentioned above, heat is conducted through wall 40 and otherwise into material of rotor 30. Coolant may be conveyed, such as by pumping, into coolant inlet 44, and thenceforth into manifold 60. Coolant, in liquid, gaseous, or indeterminate form, can be supplied via inlet runner 61 to conduits 62 at a plurality of locations. Suitable coolants include conventional refrigerant fluids, gasses of other types, water, chilled brine, or any other suitable fluid that can be conveyed through rotor 30. Coolant impinging upon inner heat exchange surface 38 can absorb heat, in some instances changing phase upon or in the vicinity of surface 38, and then be conveyed out of rotor 30 by way of outlet 48.

In a practical implementation strategy, material such as a metal or metal alloy from which rotor body 34 is made will typically extend continuously between heat exchange surface 38 and outer compression surface 36, such that the respective surfaces could fairly be understood to be located at least in part upon outer body wall 40. In a practical implementation strategy, rotor body 34 is a one-piece rotor body or includes a one-piece section wherein cavity 80, inlet runner 61 and conduits 62 are formed. In certain instances rotor body 34 or the one-piece section may have a uniform material composition throughout. It is contemplated that rotor 30 can be formed by material deposition as in a 3D printing process. Those skilled in the art will be familiar with uniform material composition in one-piece components that is commonly produced by 3D printing. It should also be appreciated that in alternative embodiments, rather than a uniform material composition 3D printing capabilities might be leveraged so as to deposit different types of materials in rotor body 34 or in parts thereof. Analogously, embodiments are contemplated where rotor body 34 is formed from several pieces irreversibly attached together, such as by friction welding or any other suitable process.

Figure 2:
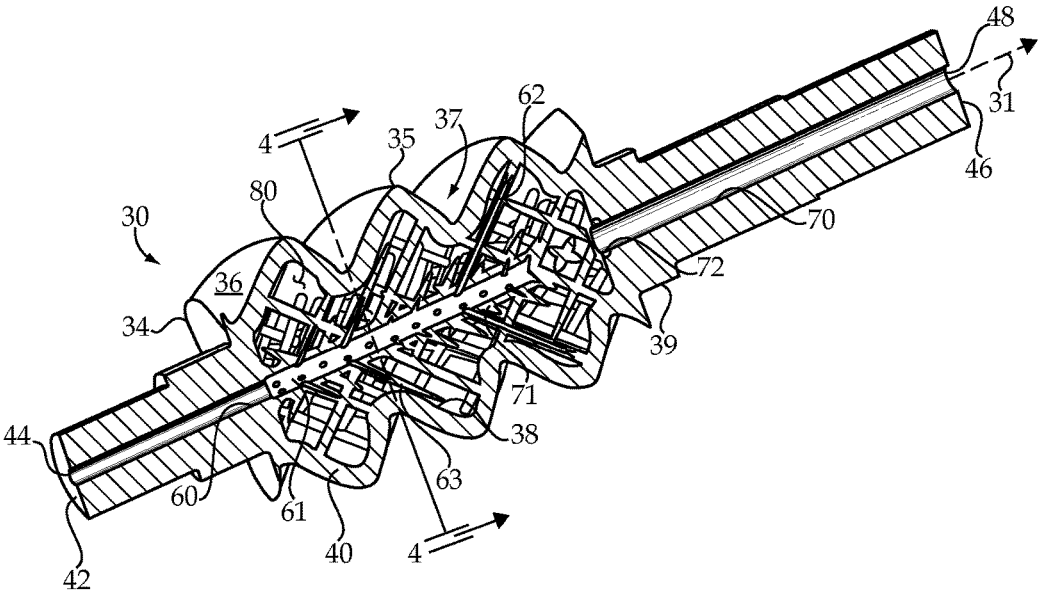
FIG. 2 is a sectioned view of a rotor, in perspective, suitable for use in a compressor system as in FIG. 1.
Figure 3:
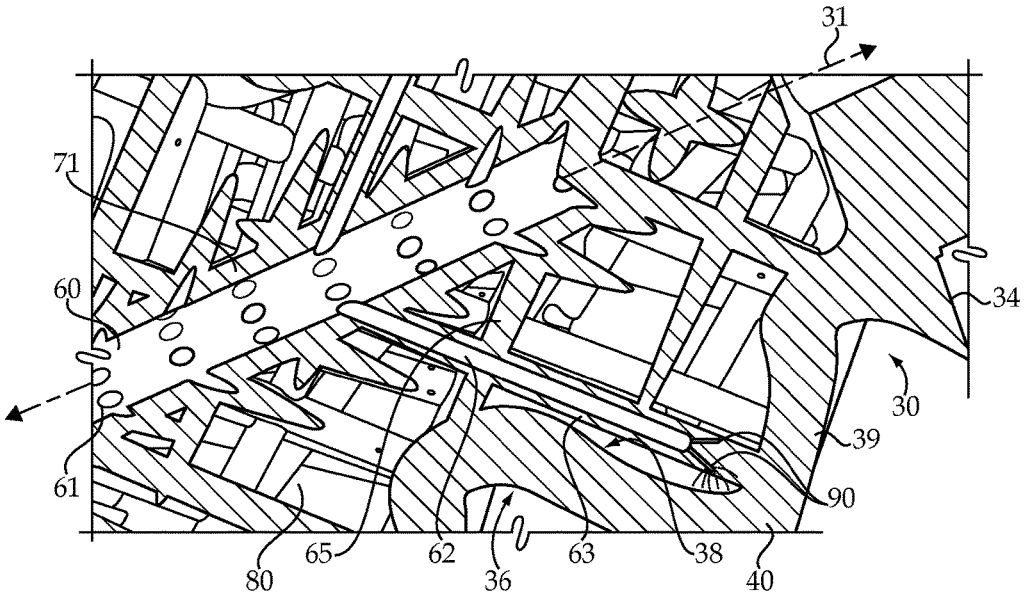
FIG. 3 is an enlarged view of a portion of FIG. 2.

Returning to the subject of coolant delivery and distribution, as noted above coolant is delivered to the one or more heat exchange surfaces 38 at a plurality of axial and circumferential locations. From FIG. 1 it can be seen that conduits 62 are at a plurality of different axial locations, and also a plurality of different circumferential locations, relative to axis 31. Referring also now to FIG. 2 and FIG. 3, it can be seen that conduits 62 may each be understood to include or be in fluid communication with one or more spray orifices 90. In a practical implementation strategy, each conduit 62 may connect with a plurality of orifices such as spray orifices 90 that fluidly connect the corresponding conduit 62 with cavity 80. The coolant can be understood to be sprayed in at least certain instances directly onto heat exchange surface 38 at the plurality of axial and circumferential locations. Where a refrigerant is used, the refrigerant may undergo a phase change within rotor 30, transitioning from a liquid form to a gaseous form and absorbing heat in the process. In other instances, refrigerant might be provided or supplied into rotor 30 in a gaseous form, still potentially at a temperature below a freezing point of water, or within another suitable temperature range, depending upon cooling requirements. Coolant can exit cavity 80 by way of a drain 72 that connects with a drain passage 70, in turn fluidly connecting to outlet 46. Drain 72 can have an annular form circumferential of axis 31 in certain embodiments.

Figure 4:
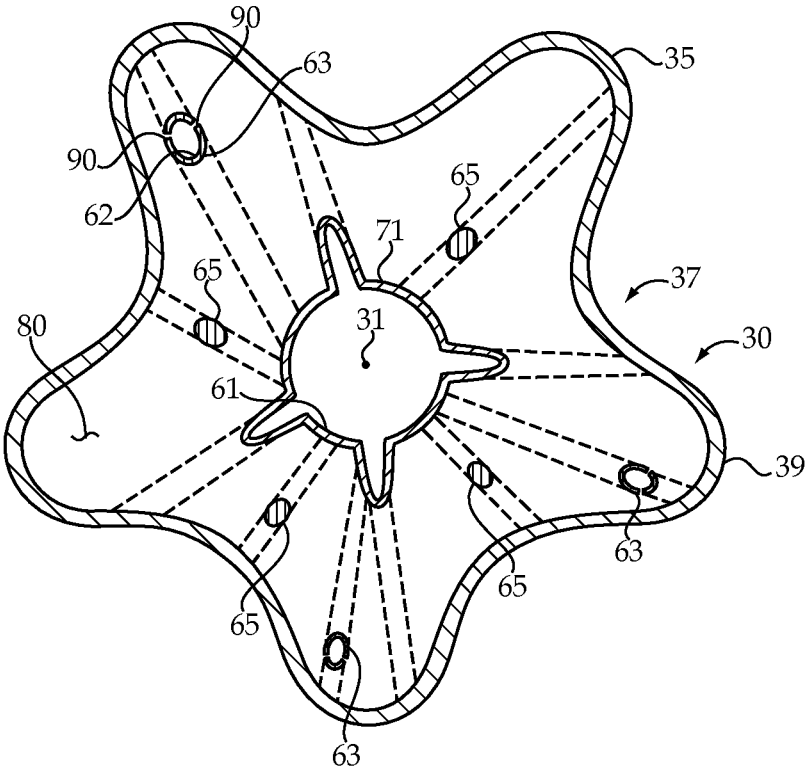
FIG. 4 is a sectioned view taken along line 4-4 of FIG. 2.

It can further be seen from FIGS. 2 and 3 that rotor 30 may have a longitudinal central column 71, centered on longitudinal axis 31. A plurality of struts 63 connect between column 71 and inner heat exchange surface 38. Inlet runner 61 extends through central column 71, and coolant supply conduits 62 extend through struts 63. It can further be seen that struts 63 are oriented so as to extend outwardly from central column 71 and axially advance toward second axial end 46. Another plurality of struts 65 are oriented so as to axially advance toward first axial end 42. In the illustrated embodiment, each of struts 63 and 65 may have orientations so as to be oriented at about 45 degrees with respect to longitudinal axis 31. Struts 65 may be solid, whereas struts 63 may be hollow by virtue of conduits 62 therein. Referring also to FIG. 4, there is shown a sectioned view taken along line 4-4 of FIG. 2. It can be seen that struts 63 and struts 65 extend into and out of the plane of the page, with features not visible in the section plane shown in phantom. It can also be seen that rotor body 31 has five lobes 35 alternating with five grooves 37. As suggested above, a greater or lesser number of lobes might be present in alternative designs. Also, while rotor 30 is depicted as a male rotor in other instances rotor 30 might have a female configuration.

Operating compressor system 10 and compressor 12 will generally occur by rotating rotor 30 within housing 22 to compress a gas via impingement of outer compression surface 36 on the gas in a generally known manner. During rotating rotor 30, coolant may be conveyed into coolant manifold 60 within rotor 30, and from manifold 60 to coolant supply conduits 62. Heat exchange surface 38 may be sprayed with coolant from conduits 62 at a plurality of axially and circumferentially distributed locations, so as to dissipate heat that is generated by the compression of the gas. As noted above, the conveying and spraying may include conveying and spraying a refrigerant in liquid form that undergoes a phase change within rotor 30, which is then exhausted in gaseous form from rotor 30. The present disclosure is not limited as such, however, and other coolants and cooling schemes might be used.

During operation, rotor 30 may experience axial thrust loads, bending loads, twisting loads and still others to varying degrees depending upon the specific design and the service environment. Such loads are commonly reacted via thrust and/or journal bearings, however, the rotor body itself can potentially be deflected during service and its constituent material can eventually experience some degree of material fatigue, potentially even ultimately leading to performance degradation or failure. In certain known rotor designs, for various reasons, among them commonly an abundance of material from which the rotor is made, a service life of the compressor system can be limited by factors other than material fatigue in the rotor. For that reason, the mechanical integrity of the rotor would not commonly be a limiting factor in the service life of the system. From the foregoing description, it will be understood that rotor 30 may be constructed with a relatively small amount of material, with rotor body 31 being relatively light in weight.

Constructing rotor 30 as described herein enables rotor 30 to be relatively inexpensive from the standpoint of materials, as well as relatively efficient to cool. To compensate for reduced mechanical integrity that might otherwise be observed in a light weight rotor of reduced material, struts 63 and 65 can serve to stiffen rotor body 31. In some instances struts 63 and 65 intersect, and can form an internal stiffening framework with material being placed where optimally necessary to manage the expected loads on the system. Another way to understand this principle is that with cooling more than adequately provided for structural considerations can predominantly drive the placement of material rather than cooling requirements. Alternative embodiments are contemplated where struts are provided that axially advance only in one direction, in other words the struts only run one way. In still other instances, struts could be oriented in helical patterns, either the same as or counter to the helical form of lobes 35 and grooves 37.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A rotor for a compressor system comprising:

a rotor body defining a longitudinal axis extending between a first axial body end and a second axial body end, and having an outer compression surface structured to impinge during rotation of the rotor body upon a gas conveyed between a gas inlet and a gas outlet in a housing;

the rotor body further including an inner heat exchange surface defining a cooling cavity, and having formed therein a coolant inlet, a coolant outlet in fluid communication with the cooling cavity, and a coolant manifold; and the coolant manifold having an inlet runner fluidly connected with the coolant inlet, and a plurality of coolant supply conduits having an axial and circumferential distribution and extending outwardly from the inlet runner so as to direct a coolant fluid toward the inner heat exchange surface;

wherein the cooling cavity is structured to collect the coolant fluid exiting the plurality of coolant supply conduits.

2. The rotor of claim 1 wherein the rotor body further includes a longitudinal central column, and a plurality of struts connecting between the central column and the inner heat exchange surface, and wherein the inlet runner extends through the central column and the plurality of coolant supply conduits extend through the plurality of struts.

3. The rotor of claim 2 wherein the plurality of struts are oriented so as to axially advance toward the second axial end.

4. The rotor of claim 3 wherein the rotor body further includes another plurality of struts connecting between the central column and the inner heat exchange surface and oriented so as to axially advance toward the first axial end.

5. The rotor of claim 3 wherein each of the plurality of struts includes a spray orifice fluidly connecting the corresponding coolant supply conduit to the cooling cavity.

6. The rotor of claim 1 wherein the rotor body includes a one-piece section wherein struts are located.

7. The rotor of claim 6 wherein the rotor body has a uniform material composition throughout.

8. The rotor of claim 6 comprising a screw rotor where the outer compression surface forms a plurality of helical lobes in an alternating arrangement with a plurality of helical grooves, and wherein the inner heat exchange surface has a shape complementary to the outer compression surface.

9. The rotor of claim 8 wherein the rotor body further incudes a drain annulus fluidly connecting the cooling cavity with a drain outlet.

10. A rotor for a compressor system comprising:

a rotor body defining a longitudinal axis extending between a first axial body end and a second axial body end, and including an outer compression surface and an inner heat exchange surface defining a cooling cavity;

the rotor body further including a longitudinal column extending through the cooling cavity, and a plurality of struts extending from the central column to the inner heat exchange surface; and a coolant manifold including an inlet runner formed in the longitudinal column, and a plurality of coolant supply conduits structured to supply a coolant to the inner heat exchange surface and extending through the plurality of struts;

wherein the cooling cavity is structured to receive the coolant fluid discharged from the plurality of coolant supply conduits.

11. The rotor of claim 10 wherein each of the struts has a spray orifice formed therein and fluidly connected with the corresponding fluid supply conduit.

12. The rotor of claim 11 wherein the plurality of struts have an axial and circumferential distribution.

13. The rotor of claim 11 wherein the plurality of struts are oriented so as to axially advance toward the second axial end.

14. The rotor of claim 13 further comprising a plurality of solid struts oriented so as to axially advance toward the first axial end.

15. The rotor of claim 14 wherein the rotor includes a screw rotor where the outer compression surface forms a plurality of helical lobes in an alternating arrangement with a plurality of helical grooves, and wherein the inner heat exchange surface has a shape complementary to the outer compression surface.

16. A compressor system comprising:

a housing having formed therein a gas inlet and a gas outlet;

a rotor rotatable within the housing to compress a gas conveyed between the gas inlet and the gas outlet, and including a rotor body defining a longitudinal axis extending between a first axial body end and a second axial body end;

the rotor body further having an outer compression surface, an inner heat exchange surface defining a cooling cavity, a coolant inlet formed in the first axial body end, and a coolant outlet formed in the second axial body end and in fluid communication with the cooling cavity; and the rotor body further including a coolant manifold having an inlet runner fluidly connected with the coolant inlet, and a plurality of coolant supply conduits having an axial and circumferential distribution and extending outwardly from the inlet runner so as to convey a coolant into the cooling cavity to contact the inner heat exchange surface, wherein the cooling cavity is an internal space through which the plurality of coolant supply conduits traverse.

17. The system of claim 16 wherein the plurality of coolant supply conduits project outwardly from the inlet runner in axially and radially advancing directions, and such that the axial and circumferential distribution is substantially uniform.

18. The system of claim 17 wherein the rotor body further includes a longitudinal center column extending axially through the cooling cavity between the first axial end and the second axial end, and the inlet runner extends through the center column.

19. The system of claim 18 wherein the rotor body further includes a plurality of struts extending between the central column and the inner heat exchange surface, and the plurality of cooling conduits are formed one within each of the plurality of struts.

20. The system of claim 19 wherein each of the plurality of struts has a spray orifice formed therein and oriented so as to direct a spray of coolant toward the inner heat exchange surface.

21. The system of claim 16 comprising a screw rotor where the outer compression surface includes a plurality of helical lobes in an alternating arrangement with a plurality of helical grooves, and wherein the rotor includes one of a male rotor and a female rotor, and further comprising the other of a male rotor and a female rotor rotatable within the housing and enmeshed with the first rotor.

* * * * *